US005921031A

United States Patent [19]

Williams

[11] Patent Number: 5,921,031

[45] Date of Patent: Jul. 13, 1999

[54] FOLDING BARRIER FOR RETRACTABLE SPORT BLEACHERS

[76] Inventor: Arvel J. Williams, 12806 84th St., Lake Stevens, Wash. 98258

[21] Appl. No.: 09/008,142

[22] Filed: Jan. 16, 1998

Related U.S. Application Data

[60] Provisional application No. 60/035,575, Jan. 16, 1997.

[51] Int. Cl.[6] ..... E04H 3/30

[52] U.S. Cl. ..... 52/8; 52/9; 160/333

[58] Field of Search ..... 52/8, 9; 160/40, 160/333; 182/138, 139, 140, 129

[56] References Cited

U.S. PATENT DOCUMENTS

| | | | |
|---|---|---|---|
| 3,004,769 | 10/1961 | Turner | 280/150 |
| 3,392,801 | 7/1968 | Gethmann | 182/178 |
| 3,425,173 | 2/1969 | Carlo | 52/8 |
| 4,091,857 | 5/1978 | Jacobs | 160/330 |
| 4,571,895 | 2/1986 | Lyman, Jr. | 52/9 |
| 4,805,735 | 2/1989 | Anderson | 182/138 |
| 5,038,889 | 8/1991 | Jankowski | 182/129 |
| 5,358,025 | 10/1994 | Wood | 160/368.1 |
| 5,661,928 | 9/1997 | Beu | 52/9 |

*Primary Examiner*—Carl D. Friedman
*Assistant Examiner*—Dennis L. Dorsey
*Attorney, Agent, or Firm*—Todd N. Hatheway

[57] ABSTRACT

A barrier assembly for mounting to the end of a folding bleacher assembly for blocking access to the area under the bleacher seats. The folding barrier panel may be constructed of a heavy-gauge fabric material. The rearward edge of the panel is attached to a stationary connection at the rearward end of the bleacher assembly, and the forward edge of the panel is attached to a moving connection at the forwardmost seat section, so that the panel is pulled out straight when the bleacher assembly is extended. A chain or cable along the lower edge of the panel member is also stretched out straight between the two connections, so as to prevent persons from lifting the lower edge of the panel and passing thereunder. The upper edge of the panel may be attached directly to the rearward edges of the stacked deck sections, or it may be suspended from the deck sections on a series of pendant chains. In a collapsed configuration, the barrier assembly folds in a compact space behind the stacked rows of the bleacher assembly, and when extended forms a firm, flat barrier for preventing entry under the bleacher assembly.

23 Claims, 6 Drawing Sheets

FOLDING BARRIER FOR RETRACTABLE SPORT BLEACHERS

This Application is a provision of Ser. No. 60/035,575 filed Jan. 16, 1997.

BACKGROUND a. Field of the Invention

The present invention relates generally to safety devices for sports bleachers, and, more particularly, to a folding barrier which prevents unauthorized access beneath folding bleachers when these are in the extended position.

b. Background Art

Folding bleacher systems are widely installed in modern sports facilities, such as high school/college gymnasiums and professional sports arenas. These systems are available from a number of different manufacturers (e.g., Hussy Seating Company, North Berwick, Me.; Universal/Interkal Bleachers, Kalamazoo, Mich.; Folding Bleachers, Altamont, Ill.; Sheridan Bleachers, Orillia, Ontario, Canada; and Seattle Seating, Seattle, Wash.) and typically include a folding linkage made up of a multiplicity of bars and supports actuated by one or more electric motors. Several rows of bleacher seats are mounted atop the folding linkage, and the seat portions of these typically pivot forwardly as the assembly retracts flat against the support wall to which it is mounted. Folding bleachers have the advantage of making additional floor space available when seating is not needed for a spectator event.

A persistent problem with folding bleachers, however, has been that of unauthorized personnel gaining access to the area under the bleacher seats when they are in the extended position. The ends of the folding bleachers are exposed when they are extended, and people (typically, juveniles) are prone to enter this area and become injured, either from climbing on/falling from the various supports and linkages of the folding bleacher system, or by being struck by objects dropped onto them by the spectators above.

These injuries have become a constant source of liability for the schools or other owners of sports facilities, as well as for the bleacher manufacturers themselves. However, until now there has been virtually no solution available for this problem, apart from the unsatisfactory expedient of posting guard personnel at each end of the bleachers when they are extended. Furthermore, rigid barriers do not provide a satisfactory solution, since they have to be removed and stored away separately when the bleachers are retracted.

Accordingly, there exists a need for an apparatus for effectively excluding unauthorized personnel from entering under folding bleachers when these are in the extended position. Furthermore, there is a need for such an apparatus which does not need to be mounted to and removed from the bleacher system each time it is used. Still further, there is a need for such an apparatus which is economical to manufacture and maintain, yet will also be durable and enjoy a long service life.

SUMMARY OF THE INVENTION

The present invention has solved the problems cited above, and is a barrier assembly having a folding panel which is mounted to one or more ends of a bleacher assembly for blocking access to the area under the bleacher seats.

The folding barrier panel may be constructed of a heavy gauge folding fabric material, with a rearward edge thereof being mounted to the wall at the back of the bleacher assembly and the forward edge being mounted to the front row of seats. The upper edge of the barrier panel is positioned high enough that the panel forms an effective barrier to unauthorized entry under the bleacher seats. The barrier panel may extend a partial height of the bleacher assembly, with its upper edge being suspended from the overlying tiers of seats. The upper edge of the panel may be suspended by pendant chains which are attached to brackets at the rearward edges of the bleacher decks. In some embodiments, the upper edge of the panel may extend at a angle along the rearward edges of the bleacher decks, rather than forming a horizontal edge which is suspended at a distance below the rear edges of the decks.

In a preferred embodiment, the barrier assembly comprises a collapsible panel member having upper and lower edges and forward and rearward edges, with means for mounting a rearward edge of the panel member to a stationary connection at a rearward end of the bleacher assembly and the forward edge of the panel member to a moving connection at a forward end of the bleacher assembly, so that the lower edge of the panel member is positioned closely adjacent a floor surface under the bleacher assembly and the upper edge of the panel member is positioned at a height above the floor surface which is sufficient to prevent persons from climbing over the panel member. The panel member has a length from its rearward edge to its forward edge which is selected such that the panel member is pulled out generally straight between the moving and stationary connections when the bleacher assembly is in its extended position, so as to form a firm, generally flat barrier which blocks entry beneath the bleacher assembly.

The panel member may comprise a flexible, folding screen member, and this may be formed of a flexible fabric material or a flexible mesh material.

The barrier assembly may further comprise means for suspending a middle portion of the panel member from the bleacher assembly, and this may comprise means for suspending the middle portion of the panel member at the upper edge thereof.

The assembly may further comprise means for holding the lower edge of the panel member closely adjacent the floor surface so as to prevent persons from raising the lower edge of the panel member and passing thereunder. This may comprise a flexible cable member attached along the lower edge of the panel member and having first and second ends connected to the stationary and moving connections of the assembly, the cable having a length such that when the bleacher assembly is in the extended position the cable member is pulled out generally straight between the moving and stationary connections. The cable member may comprise a length of rope or chain material. Further, the cable member may comprise a length of comparatively heavy chain material, which is suspended above the floor surface so that the weight draws downwardly so as to pull the panel member generally taut between the lower edge and upper edge which suspended from the bleacher assembly.

The means for suspending the panel member from the bleacher assembly may comprise means for attaching rearward edges of a plurality of stepwise extending deck sections in said bleacher assembly to corresponding attachment points along the upper edge of the panel member which are in substantially vertical alignment with the rearward edges of the deck sections.

The means for attaching the rearward edges of the deck sections to the points along the upper edge of the panel member may comprise a plurality of pendant members, each pendant member extending in a substantially vertical direction from a connection point on the rearward edge of the deck section to a corresponding attachment point on the upper edge of the panel member. The pendant members may comprise lengths of flexible chain material.

The means for attaching the rearward edges of the deck sections to the points along the upper edge of the panel member may further comprise a plurality of bracket members, each bracket member being mounted to and extending rearwardly from a rearward edge of one of the deck sections, and having a rearward end to which an upper end of one of the pendant members is attached. The bracket members increase in length from a shortest bracket member, which is mounted to the lowermost and forwardmost deck section in said bleacher assembly, to the longest bracket member, which is mounted to an uppermost and rearwardmost deck section, so that when the bleacher assembly is in a collapsed configuration the rearward ends of the bracket members are arranged in a stepwise configuration such that the pendant members extend downwardly therefrom parallel to one another at closely-spaced intervals, for compact storage of the barrier assembly without tangling of the pendant members. The rearward ends of the bracket members may be staggered from side-to-side so as to permit a plurality of the pendant members to extend downwardly therefrom in a common transverse plane without contacting one another.

DETAILED DESCRIPTION

Figure 1:
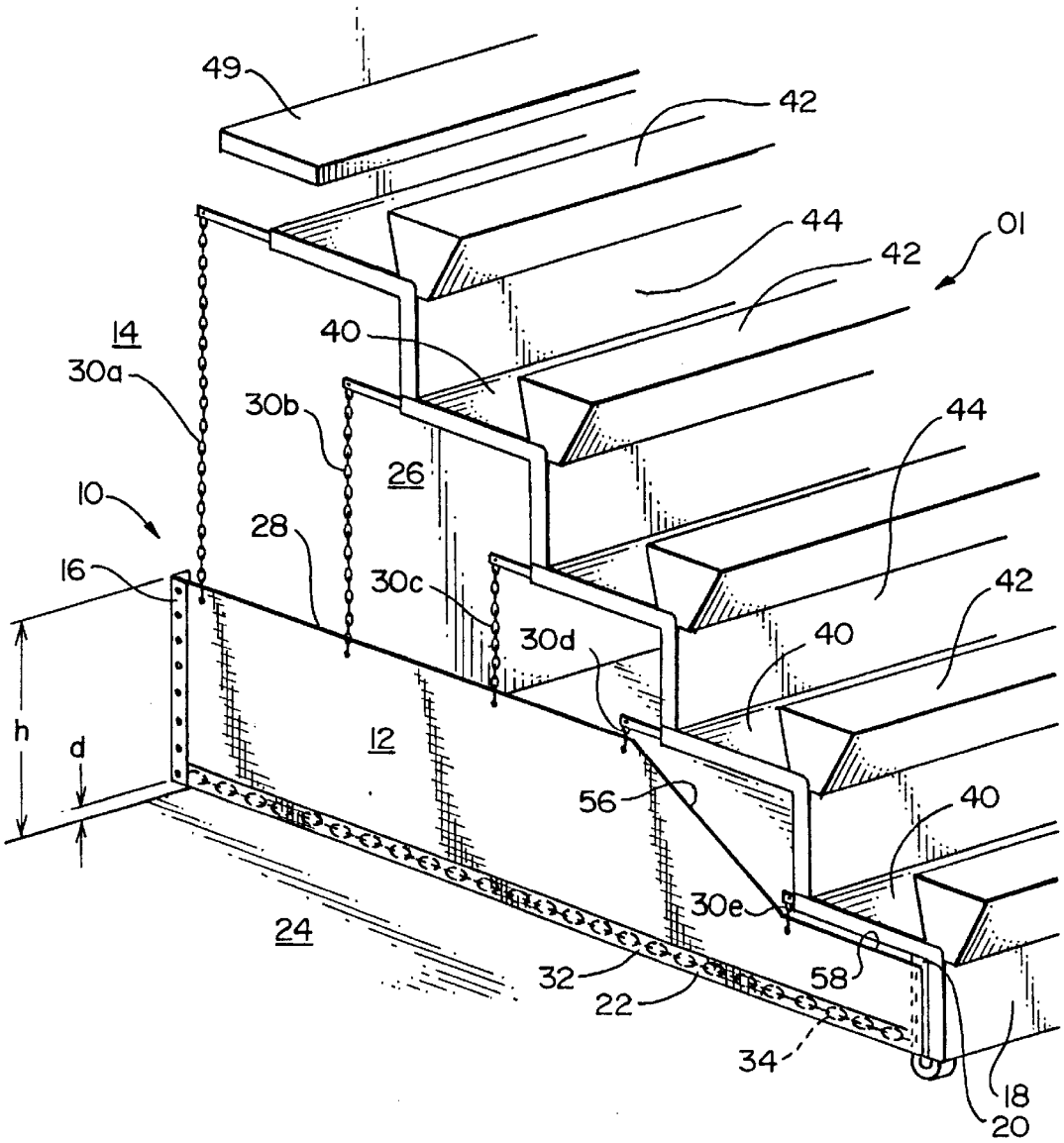
FIG. 1 is a perspective view of an end portion of a folding bleacher assembly having a folding barrier assembly in accordance with the present invention mounted thereto for blocking access to the area underneath the bleacher seats.

FIG. 1 shows folding bleachers 01 having a folding barrier assembly 10 in accordance with the present invention mounted to an end thereof. The bleacher assembly 01 is shown in a somewhat simplified form in the drawings for the sake of clarity, i.e., without the underlying supports and framework, and with only a few rows of seats; it will be understood that in many installations the bleacher assembly may have upwards of 20 rows of seats. Furthermore, although the folding barrier assembly of the present invention is shown mounted at the right-hand end of the bleachers in FIGS. 1–3, it will be understood that a mirror-image identical assembly will ordinarily be installed at the opposite end of the bleacher assembly, except for in those installations where this butts up against a vertical wall surface so that no barrier is needed.

As can be seen with further reference to FIG. 1, the barrier assembly 10 includes a folding barrier panel 12 having a rearward edge which is mounted to the wall 14 by a stationary attachment bracket 16, and a forward edge which is attached to the front row 18 of the bleacher seats by second, moving attachment bracket 20. The length of the barrier panel is selected such that this will be pulled out at least more-or-less straight, or taut in some embodiments, when the bleacher assembly is fully extended.

In the embodiment which is illustrated, the barrier panel 12 is constructed of a heavy fabric material which drapes and folds evenly, such as heavy reinforced vinyl fabric. Suitably this may be a 10–30 ounce reinforced vinyl fabric, such as an 18 ounce reinforced vinyl fabric available from Cooley, Inc. of Rancho Cucamunga, Calif. Other suitable materials may be used for the folding barrier panel, however, such as folding steel or plastic screen or mesh, for example.

The lower hem 22 of the barrier panel is suspended a short distance "d" above the floor 24, and the panel extends upwardly from this to form a barrier which blocks access to the area 26 beneath the bleacher seats. In the embodiment which is illustrated, the upper edge 28 does not extend the full height of the assembly, but is instead suspended by pendant chains 30*a*, 30*b*, 30*c* . . . , along a horizontal line at a height (e.g., 5') which has been determined to provide an effective personnel barrier for the particular installation.

The lower edge 22 of the folding barrier, in turn, is provided with a horizontal sleeve portion 32. A comparatively heavy chain 34 extends through this, with its rearward end being mounted to the wall attachment bracket 16 and its forward end being mounted to the front attachment bracket 20. The length of the chain 34 between its attachment points is approximately equal to, but preferably just slightly longer than, the horizontal distance between the wall bracket 16 and the front row bracket 20; For example, in many installations it is preferably that chain 34 be approximately 2" longer than the distance between the two attachment points. This is important because most folding bleacher systems overextend a slight amount (e.g., 2") at the outer end of their travel, and the 2" of additional length in chain 34 permits this to occur without the chain being jerked taught and causing excessive stresses on the attachment brackets and support/drive mechanisms of the bleachers, but without adding so much slack that the chain can be lifted very far above the floor.

The chain 34 serves primarily to prevent persons from lifting the lower edge of the panel and slipping under this. The use of heavy chain material for the purpose has a number of advantages, because it folds well and its weight makes it difficult to lift, and also because it cannot be cut with a knife. Also, the weight of the chain pulling downwardly on the bottom edge of the panel helps to draw the panel taut in a vertical direction, thereby forming a firmer, neater barrier. It will be understood, however, that in some embodiments other suitable flexible lines, such as various types of rope or cable, may be used to hold down the hem of the panel, so long as their length is such that they will be pulled more or less taut when the bleacher assembly is in its extended configuration.

Figure 2:
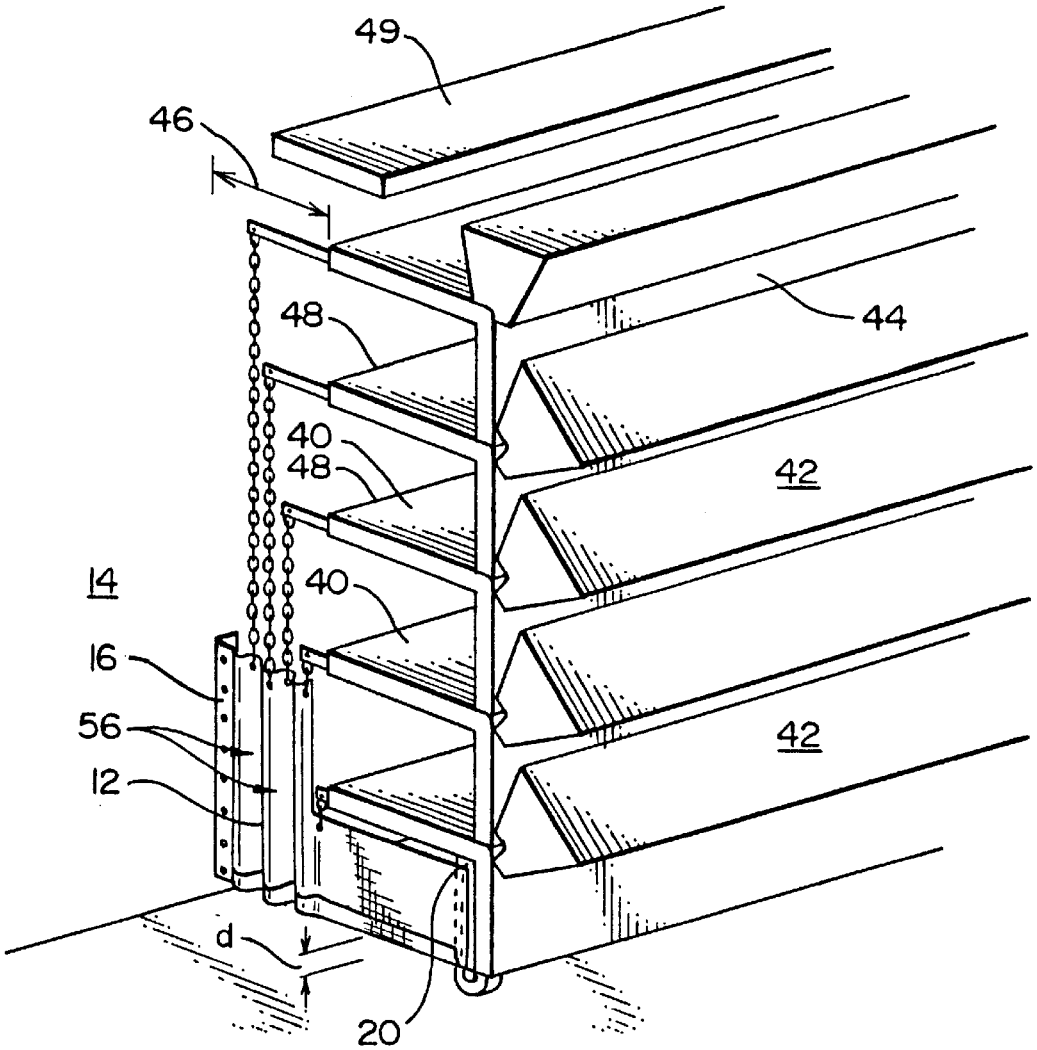
FIG. 2 is a perspective view of the end portion of a folding bleacher system of FIG. 1, showing this in the retracted position with the barrier assembly of the present invention folded adjacent the wall to which the bleacher system is mounted.

As can be seen in FIG. 2, when the bleacher assembly 01 is retracted to its stored position, the deck portion 40 of each seat row slides under the row behind it, until the assembly is compressed against the wall and the risers 44 and seats 42 of all the rows are substantially in vertical alignment.

As this is done, the panel portion 12 of the folding barrier assembly folds up in the standoff gap 46 between the support wall 14 and the rear edges 48 of the bleacher decks. The gap is formed by standoffs (not shown) mounted between the wall and bleacher assembly, and the upper end of the gap is ordinarily covered by a fixed platform or mezzanine 49. Although the width of the platform or mezzanine can vary considerably (for example, in some installations the platform can be several feet wide for supporting cameras and other media equipment), in most installations the width of the offset or gap 46 is in the range of only about 1'. Accordingly, the barrier assembly must be able to fold up into a comparatively narrow, vertical slot when the bleacher system is in its retracted configuration. The present invention is able to accomplish this, firstly by forming the barrier panel of fabric material which has the ability to fold together, and secondly by providing an arrangement which ensures that the multiple pendant chains 30 will extend parallel to one another when the assembly is in the retracted position, but without becoming entangled.

Figure 3:
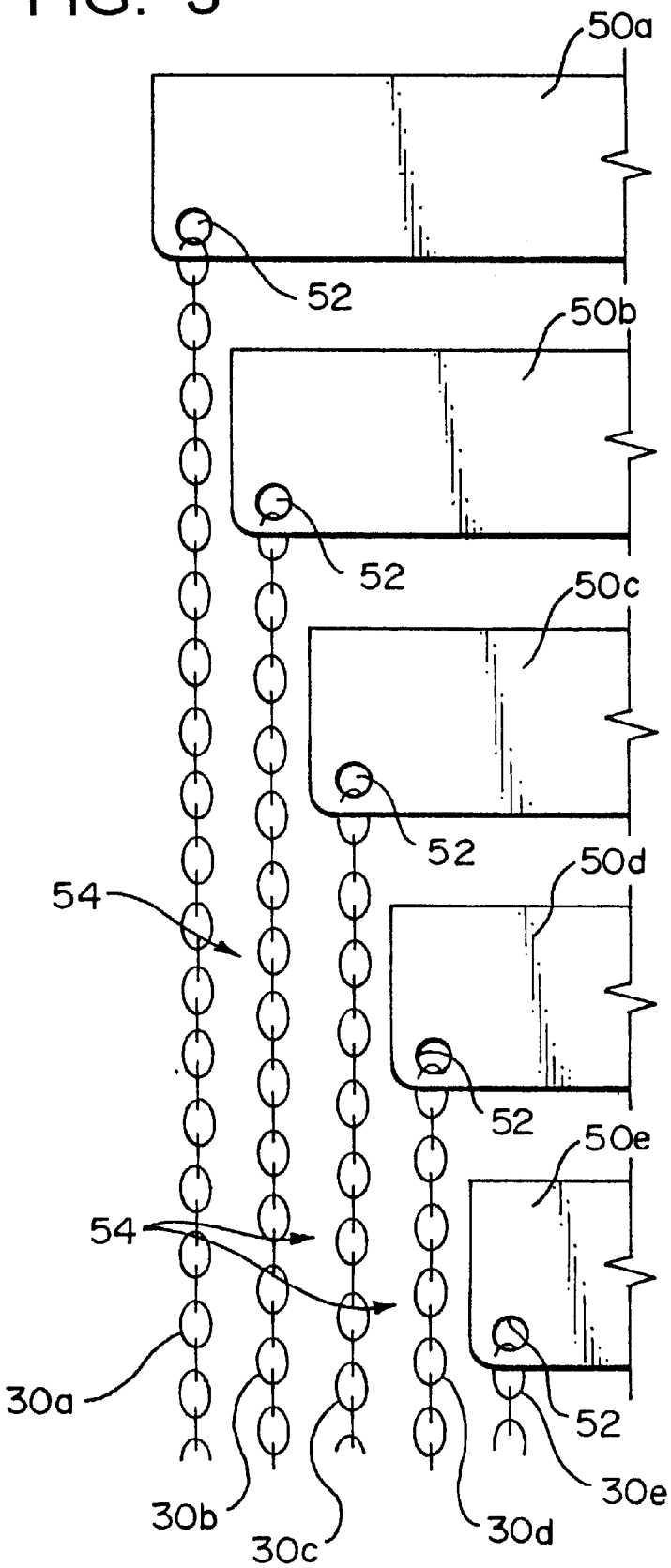
FIG. 3 is a partial, elevational view of the progressively larger brackets which support the barrier panel from the rearward edges of the bleacher decks.

In particular, as can be seen in FIG. 1, and also in FIG. 3, the pendant chains 30 are supported from a series of stepped brackets 50*a*–50*e* which are mounted to and extend rearwardly from the rear edges 48 of the bleacher decks 40. The brackets 50 are substantially identical except for their length, with an opening 52 being provided at the outer end of each bracket for attachment of the pendant chain 30, using an S-hook, shackle, or other attachment fitting. The attachment brackets 50 increase in length with each higher tier of seats, i.e., the brackets are progressively longer towards the higher rows of seats, with the difference in length between adjacent brackets being substantially constant throughout the series. For examples, in the embodiment which is shown in FIG. 3, each bracket 50 may be ⅜" longer than the one below it, i.e., exemplary lengths for brackets 50*e*–50*a* may be 1⅝", 2", 2⅜", 2¾", and 3⅛".

This arrangement of the brackets ensures that the suspension chains 30 hang straight down parallel to one another at equal spacings 54, without coming into actual contact with one another and becoming tangled. This in turn ensures that the barrier panel 12 forms even folds 56 as the bleachers retract. To ensure that the entire assembly fits neatly between the backside of the bleacher system and the support wall 14, the uppermost bracket 50 is preferably no longer than the width of the gap 46 by which the bleachers are offset forwardly from the wall. Hence, in many installations, the lengths of the brackets (and therefore the spacing of the pendant chains) can be obtained by determining the maximum permissible length of the uppermost bracket 50 (which will ordinarily be about the same as the offset gap 46) and dividing this length by the number of seat rows in the bleacher assembly, taking into account the minimum length of the lowermost mounting bracket. In some installations, however, the number of seat rows may be such that sufficient spacing between the pendant chains cannot be maintained by the increasing lengths of the brackets alone; in such cases, the ends of the brackets may be staggered (e.g., bent outwardly) right and left of center to provide lateral spacing between the pendant chains as well as longitudinal spacing, and there may be a straight centerline bracket as well, so that 3 (or more) chains can be suspended in transverse rows which are separated in the longitudinal direction by the step-wise increase in the length of the brackets.

The brackets 50 may be formed of any suitable material, such as drilled steel plate. The pendant chains 30, in turn, are selected to be strong enough to support the barrier panel and its hem chain, but not so heavy as to cause excessive weight on the attachment brackets and the rear edges of the bleacher decks; for many installations 3/32nds chain having ½" long lengths is eminently suitable, in terms of strength and weight, and this also has the advantage of allowing for easy ½" adjustments of the edges of the barrier panel, by adding/removing individual links in the suspension chains. Also, in some embodiments, other types of suspension pendants may be utilized, such as ropes or cables, but the chain pendants have the advantages of hanging very straight and being highly durable. For the reasons noted above, the hem chain 34 is preferably substantially heavier than the pendant chains, both to provide effective "ballast" for the lower edge of the barrier panel and to have sufficient strength that it cannot be broken by people lifting on the hem of the barrier, but again excessive weight should be avoided; 3/16" steel chain is an eminently suitable size for many applications.

In the embodiment which is illustrated in FIGS. 1–3, the upper edge 28 of the barrier panel 12 extends in a straight, horizontal line over most of its length, at a height "h" which is selected to effectively block personnel access, e.g., 5'. At its forward end, however, the heights of the bleacher decks drop below the level of the horizontal upper edge 28 of the panel. In this area, the panel 12 has a "bevel cut" upper edge which extends more or less directly from corner to corner between the attachment brackets at the rearward edges of the bleacher decks, down to the front row 18 of the bleacher seats, where the forward end of the panel has another horizontal upper edge 58 which extends under the front bleacher platform 40. The importance of the sloped or beveled upper edge portion 56 of the panel is that this effectively blocks access to the area under the bleacher seats where the panel is below 5' in height, but avoids a bunching of the fabric of panel 12 which would otherwise cause the bottom of the panel and the ballast chain 34 to drag on the floor surface when the bleacher assembly is extended/retracted, as would happen if the upper edge of the panel was to simply extend all the way up to the decks 40 of each of the bleacher tiers in the same way as the forwardmost edge 58. In other words, the beveled edge 56 enables a constant distance "d" (e.g., 2") to be maintained above the floor at all times as the fabric barrier panel folds and unfolds.

Figure 4:
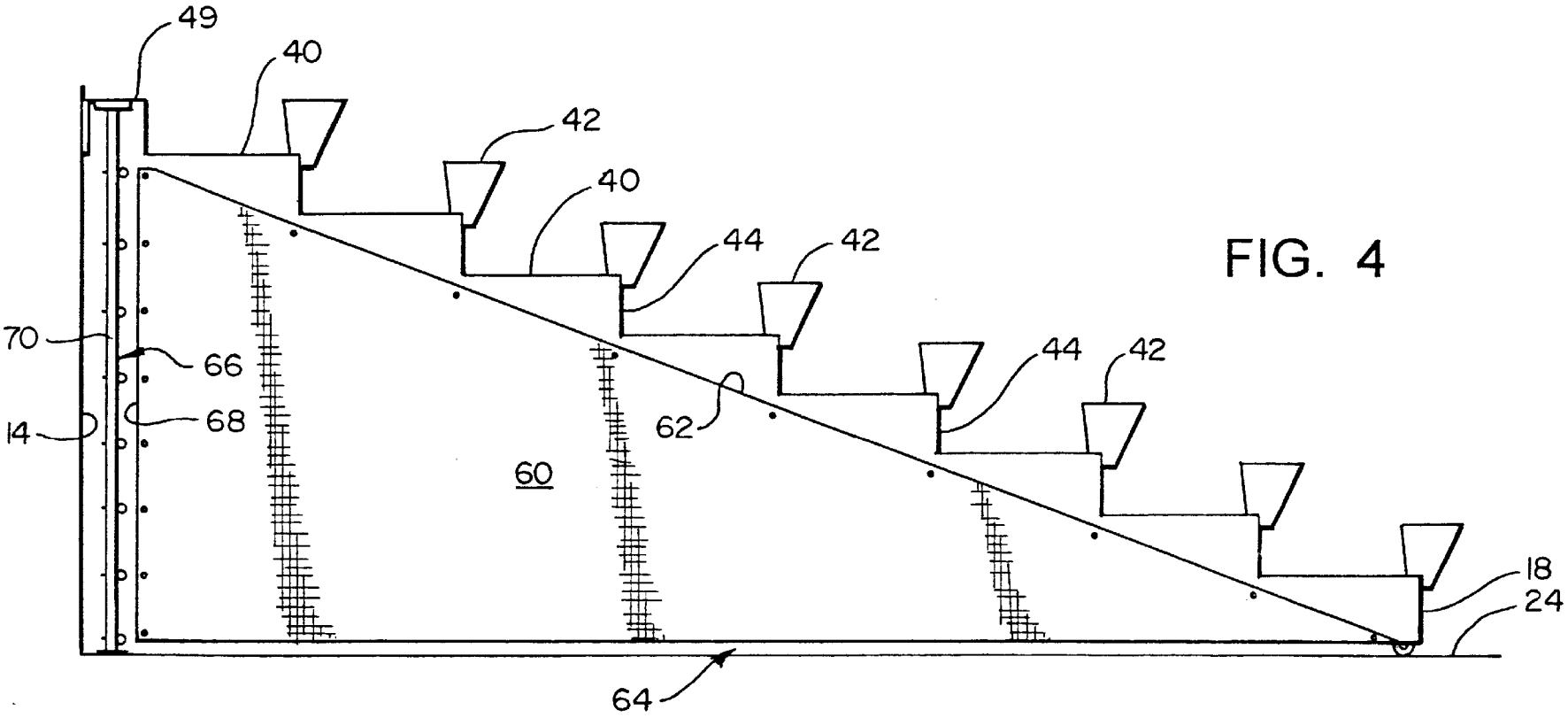
FIG. 4 is an end, elevational view of a folding bleacher system having a barrier assembly in accordance with a second embodiment of the present invention mounted thereto; this extending substantially the full height of the bleachers, rather than only partway up as shown in FIGS. 1–2.

Accordingly, as can be seen in FIG. 4, in some embodiments of the present invention the barrier assembly may include a full height barrier panel 60 having a continuous bevel cut upper edge 62 which extends in a substantially straight line between the attachment brackets along the rearward edges of all of the decks 40 of the bleacher assembly 01. As discussed above, the angled or beveled cut of the upper edge of the panel ensures that the small gap 64 along the lower edge of the panel is maintained as the bleacher assembly extends and retracts, avoiding dragging of the lower edge of the skirt along the floor. Although the partial height embodiment shown in FIGS. 1–3 has the advantage of economy, the full height version shown in FIG. 4 may be preferred in some installations for reasons of aesthetics or for providing a more complete enclosure.

Also visible in FIG. 4 is a full height post assembly 66 to which the rearward edge 68 of the barrier panel may be attached, in place of the wall bracket 16 shown in FIGS. 1–2. As can better be seen in FIG. 5, the post assembly 66 includes a vertical stanchion member 70, which may suitably be formed of box section steel tubing (e.g., 3" by 3" square steel tubing), with a series of horizontal bores 72 being formed therein at equal vertical spacings. An eye bolt 74 is threaded through each of the horizontal bores 72 so that the eye portion thereof faces forwardly from the stanchion member, with compression nuts 76 being threaded on the opposite ends to secure the eye bolts in place. The eye bolts provide the attachment points for the rearward edge 68 of the barrier panel, which is connected to the station member by S-hooks 78 which pass through the ends of the eye bolts and corresponding grommets 80 in the rearward edge of the barrier panel.

Figure 5:
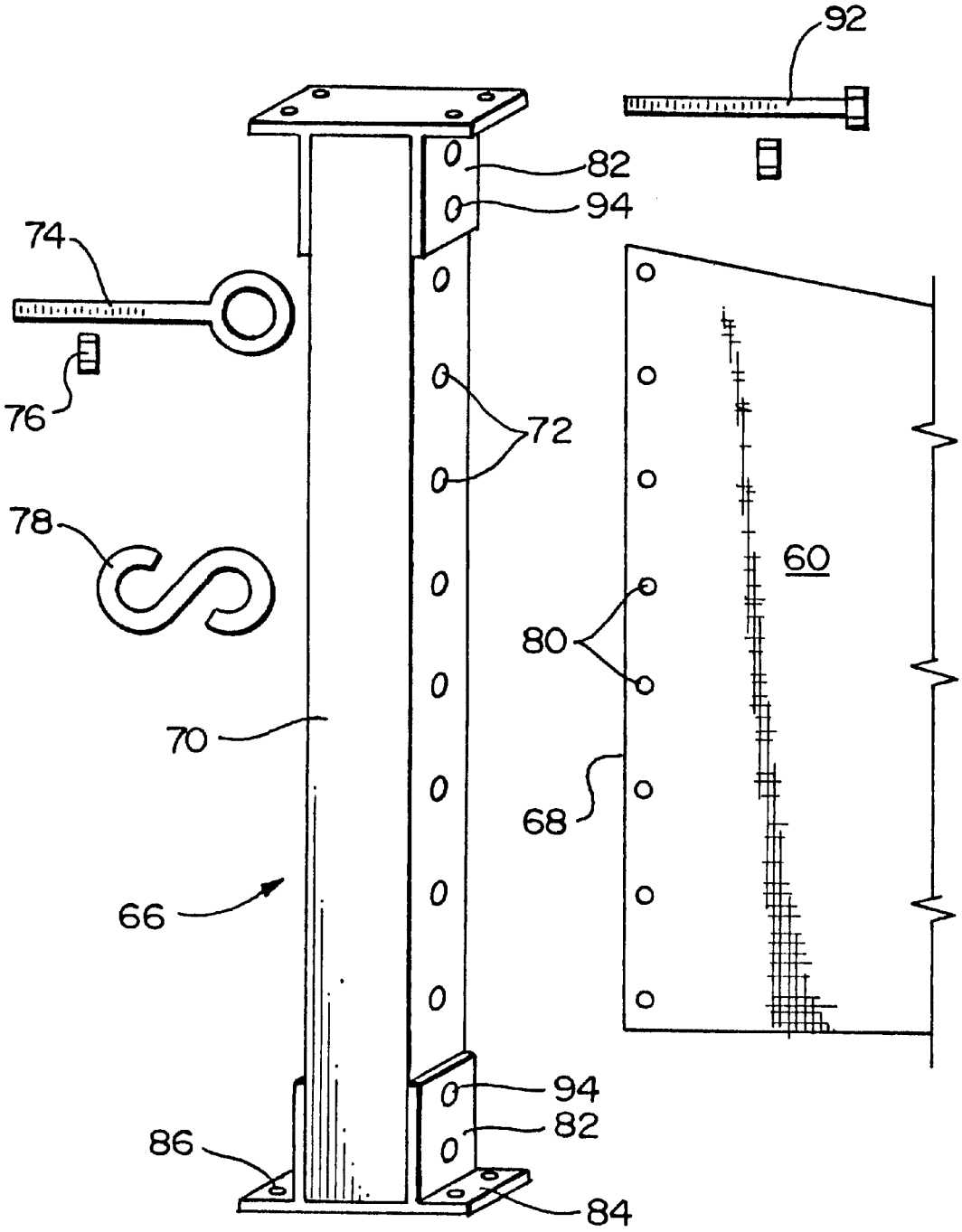
FIG. 5 is a perspective view of a support bracket for mounting the rearward edge of the folding barrier panel of the present invention adjacent the wall structure, and attachment pieces for connecting this to the edge of the fabric panel.
Figure 6:
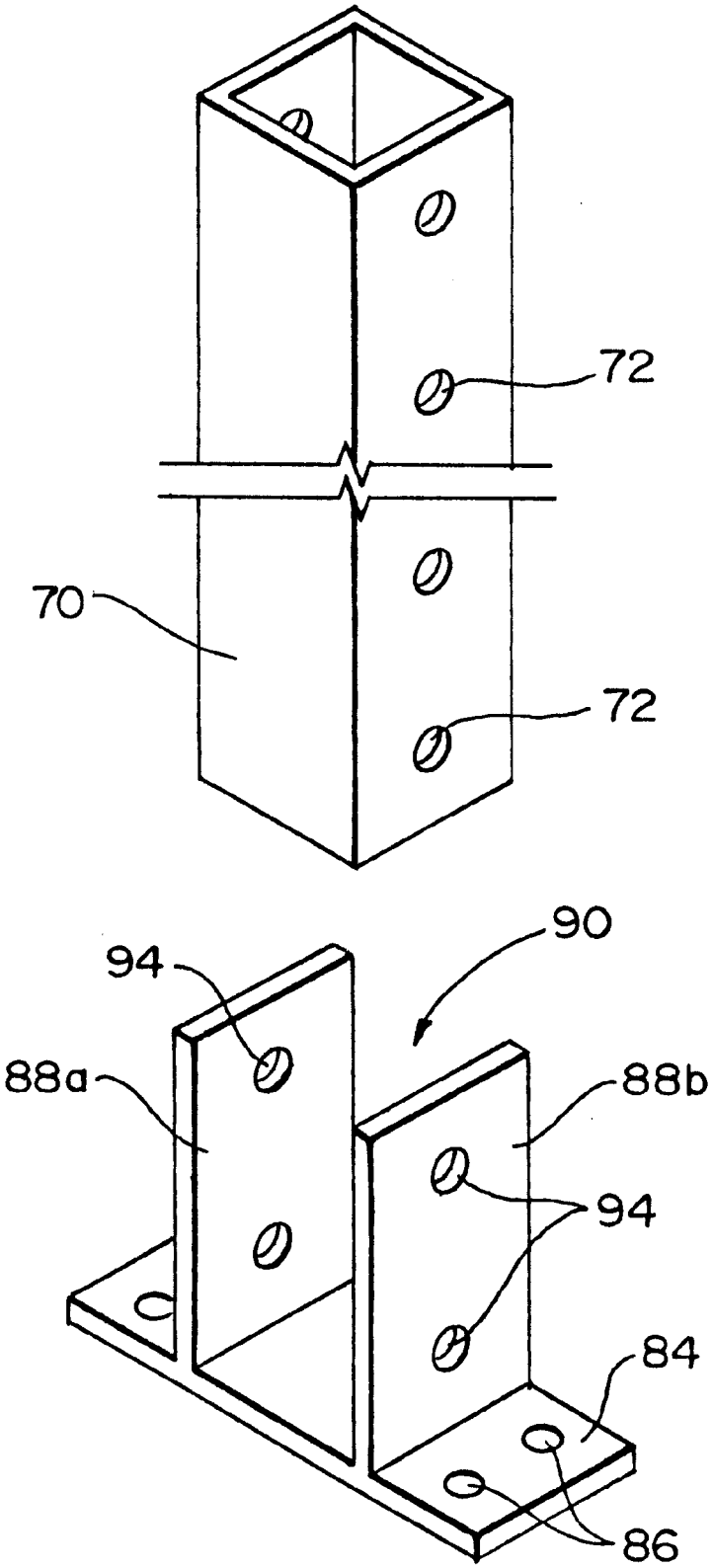
FIG. 6 is a perspective view of the bottom bracket portion of the support bracket assembly shown in FIG. 5.

As can be seen in FIG. 4, the stanchion member 70 extends the full height of the back tier of the bleacher assembly, with its ends being mounted to the floor and top platform 50 by brackets 82 (see FIG. 5). The upper lower brackets 82 are substantially identical, and, as is shown in FIG. 6, each of these includes a base plate 84 having a plurality of openings 86 for hold-down screws or other fasteners, and first and second upwardly extending, spaced apart side plates 88*a,* 88*b* which form an area 90 for receiving the end of the stanchion member in close interfit therewith, as is shown in FIG. 5. Bolts 92 are then passed through the openings 94 in the side plates to secure the upper and lower brackets 82 on the ends of the station member. With the brackets screwed or bolted to the floor and upper platform, this provides a secure, rigid attachment structure for the rear edge of the fabric barrier panel.

It is to be recognized that various alterations, modifications, and/or additions may be introduced into the constructions and arrangements of parts described above without departing from the spirit or ambit of the present invention as defined by the appended claims.

What is claimed is:

1. A barrier assembly for a folding bleacher assembly, said barrier assembly, comprising:

a collapsible panel member having upper and lower edges and forward and rearward edges, said collapsible panel member comprising a flexible, folding screen member; and means for mounting said rearward edge of said panel member to a stationary connection at a rearward end of a folding bleacher assembly and said forward edge of said panel member to a moving connection at a forward end of a bleacher assembly, so that said lower edge of said panel member is positioned closely adjacent a floor surface under a bleacher assembly and said upper edge of said panel member is positioned at a height above a floor surface which is sufficient to prevent persons from climbing over said panel member;

said panel member having a length from said rearward edge to said forward edge which is selected for mounting said panel member to a bleacher assembly such that when a bleacher assembly is in an extended position, said panel member is pulled generally out between a moving and stationary connections so as to form a generally flat barrier which blocks persons from entering beneath a bleacher assembly.

2. The barrier assembly of claim 1, wherein said flexible, folding screen member comprises:

a panel formed of flexible fabric material.

3. The barrier assembly of claim 1, wherein said flexible, folding panel member comprises:

a panel formed of flexible mesh material.

4. The barrier assembly of claim 1, further comprising means for suspending a middle portion of said panel member from a bleacher assembly.

5. The barrier assembly of claim 4, wherein said means for suspending a middle portion of said panel member comprises:

means for suspending a middle portion of said panel member at said upper edge thereof.

6. The barrier assembly of claim 5, further comprising:

means for holding said lower edge of said panel member closely adjacent a floor surface under a bleacher assembly so as to prevent a person from raising said lower edge of said panel member and passing thereunder.

7. The barrier assembly of claim 6, wherein said means for holding said lower edge of said panel member closely adjacent a floor surface comprises:

a flexible cable member attached along said lower edge of said panel member and first and second ends for connecting to a stationary and moving connections of said barrier assembly, said cable member having a length which is selected for mounting to a bleacher assembly such that when a bleacher assembly is in an extended position said cable member is pulled out generally straight between a stationary and moving connections.

8. The barrier assembly of claim 7, wherein said cable member comprises:

a length of rope material.

9. The barrier assembly of claim 7, wherein said cable member comprises:

a length of chain material.

10. The barrier assembly of claim 7, wherein said cable member comprises:

a length of heavy chain material which is suspended above a floor surface, so that the weight of said chain material draws downwardly along said lower edge of said panel member so as to pull said panel member generally taut between said lower edge and said upper edge when suspended from a bleacher assembly.

11. The barrier assembly of claim 5, wherein said means for suspending said panel member from a bleacher assembly comprises:

means for attaching rearward edges of a plurality of stepwise-extending deck sections in a bleacher assembly to corresponding attachment points along said upper edge of said panel member which are in substantially vertical alignment with said edges of said deck sections.

12. The barrier assembly of claim 11, wherein said means for attaching said rearward edges of a deck sections to said attachment points along said upper edge of said panel member comprises:

a plurality of connector members for mounting said points along said upper edge of said panel member directly to a rearward edges of a deck sections of a bleacher assembly, said upper edge of said panel member when mounted being configured to extend beneath and closely adjacent to said stepwise-extending deck sections.

13. The barrier assembly of claim 12, wherein said upper edge of said panel member has a stepwise configuration so as to closely follow an underside of said stepwise-extending deck sections when bleacher assembly in an extended position.

14. The barrier assembly of claim 12, wherein said upper edge of said panel member has a slant-cut configuration so as to extend closely adjacent rearward edges of said stepwise-extending deck sections when mounting to a bleacher assembly in an extended position.

15. The barrier assembly of claim 11, wherein said means for attaching rearward edges of deck sections of a bleacher assembly to said attachment points along said upper edge of said panel member comprises:

a plurality of pendant members, each said pendant member when mounted, extends in a substantially vertical direction from a connection point on a rearward edge of a deck section to a corresponding attachment point on said upper edge of said panel member.

16. The barrier assembly of claim 15, wherein each said pendant member comprises:

a length of flexible chain material.

17. The barrier assembly of claim 15, wherein said means for attaching said rearward edges of said deck sections of a bleacher assembly to said attachment points along said upper edge of said panel member further comprises:

a plurality of bracket members, each said bracket member for mounting to and extending rearwardly from a rearward edge of one of deck sections of a bleacher assembly and having a rearward end to which an upper end of one of said pendant member is attached;

said bracket members increasing in length, from a shortest bracket member for mounting to a deck section which is lowermost and forwardmost in a bleacher assembly in an extended configuration, to a longest bracket member for mounting to a deck section which is uppermost and rearwardmost in a bleacher assembly in an extended configuration;

so that when said bleacher assembly is in a collapsed configuration, said rearward ends of said bracket members are arranged in a stepwise configuration such that said pendant members extend downwardly from said rearward ends thereof parallel to one another at closely-spaced intervals, so as to permit compact storage of said barrier assembly without tangling of said pendant members.

18. The barrier assembly of claim 17, wherein said rearward ends of said bracket members are staggered from side-to-side so as to permit a plurality of said pendant members to extend downwardly therefrom in a common transverse plane without contacting one another.

19. A barrier assembly, comprising:

a collapsible panel member which is mountable to a folding bleacher assembly having a plurality of stacked deck sections which extend to a stepwise configuration in which a lowermost deck section is in a forwardmost position and an uppermost deck section is in a rearwardmost position, said panel member being formed of a flexible, folding material and having upper and lower edges and forward and rearward edges;

means for mounting said rearward edge of said panel member to a stationary connection at a rearward end of a bleacher assembly and said forward edge of said panel member to a moving connection attached to a lowermost deck section of a bleacher assembly, so that said lower edge of said panel member is positioned closely adjacent a floor surface under a bleacher assembly and said upper edge of said panel member is positioned at a height above a floor surface which is sufficient to prevent persons from climbing over said panel member;

said panel member having a length from said rearward edge to said forward edge which is selected for mounting said panel member to a bleacher assembly such that as a bleacher assembly moves to an extended position said panel member is pulled out generally straight between a moving connection and a stationary connection so as to form a generally flat barrier which blocks persons from entering beneath a bleacher assembly;

means for connecting said upper edge of said panel member to a deck sections so that a middle portion of said panel member is suspended therefrom; and a flexible chain member attached along a lower edge of said panel member and having first and second ends connected to a stationary and moving connections of said barrier assembly, said chain member having a length selected such that when a bleacher assembly is in an extended position said chain member is pulled out generally straight between a moving and stationary connections so as to prevent persons from raising said lower edge of said panel member which is attached to said chain member and passing thereunder;

said chain member further being suspended above a floor surface so that the weight of said chain member draws downwardly along said lower edge of said panel member so as to pull said panel member generally taut between said lower edge and said upper edge when connected to said deck sections of said bleacher assembly.

20. A collapsible panel for a barrier assembly, comprising:

a flexible, folding screen member which is mountable to a bleacher assembly having a plurality of stacked deck sections which extend to a stepwise configuration in which a lowermost deck section is in a forwardmost position and an uppermost deck section is in a rearwardmost position, said screen member having upper and lower edges and forward and rearward edges;

attachment fittings for mounting said rearward edge of said screen member to a stationary connection at a rearward end of a bleacher assembly and said forward edge of said screen member to a moving connection attached to a lowermost deck section of a bleacher assembly;

said screen member being sized such that when said screen member is mounted to said connections and a bleacher assembly is in an extended configuration, said lower edge of said screen member is positioned closely adjacent a floor surface under a bleacher assembly and said upper edge of said panel member is positioned at a height above a floor surface which is sufficient to prevent persons from climbing over said panel member;

at least one attachment fitting for connecting said upper edge of screen member to said deck sections of a bleacher assembly so that a middle portion of said panel member is suspended therefrom; and at least one attachment fitting for connecting a lower edge of a screen member to a cable member which is pulled out substantially straight between an stationary and moving connections when said bleacher assembly is in said extended position, so as to prevent persons from raising said lower edge of said screen member and passing thereunder.

21. The collapsible panel of claim 20, where said screen member comprises:

a panel formed of flexible fabric material.

22. The collapsible panel of claim 20, wherein said screen member comprises:

a panel formed of flexible mesh material.

23. The collapsible panel of claim 20, wherein said at least one attachment fitting for connecting said lower edge of said screen member to said cable member comprises:

at least one sleeve portion formed along said lower edge of said screen member for receiving said cable member therethrough.

* * * * *